US005129129A

United States Patent [19]

Collins et al.

[11] Patent Number: 5,129,129

[45] Date of Patent: Jul. 14, 1992

[54] SEAT BELT GUARD

[76] Inventors: John P. Collins, 19 Lindsay La., Broad Brook, Conn. 06016; Nancy A. Collins, 1748 Chase Pointe Apt. 1828, Virginia Beach, Va. 23454

[21] Appl. No.: 740,128

[22] Filed: Aug. 5, 1991

[51] Int. Cl.[5] ..... A44B 11/26

[52] U.S. Cl. ..... 24/633; 24/573.1

[58] Field of Search ..... 24/633, 573.1, 634–657

[56] References Cited

U.S. PATENT DOCUMENTS 4,674,303 6/1987 Salcone, II ..... 24/633 X
4,731,912 3/1988 Bonskie et al. ..... 24/633
4,878,277 11/1989 Portuese ..... 24/633
4,987,662 1/1991 Haffey et al. ..... 24/633

*Primary Examiner*—James R. Brittain
*Attorney, Agent, or Firm*—Leon Gilden

[57] ABSTRACT

A seat belt including first and second webs includes a latch housing cooperative with a buckle tongue for securement together. A container housing is positionable about the assembled latch housing and buckle tongue in a latched configuration, with the container housing including a lid hingedly mounted to the underlying container housing, with the lid including spaced flanges received within side wall openings to define side wall belt slots to contain the assembled buckle tongue and latch housing together.

5 Claims, 4 Drawing Sheets 1
2
3
4
5
6
10
11
12

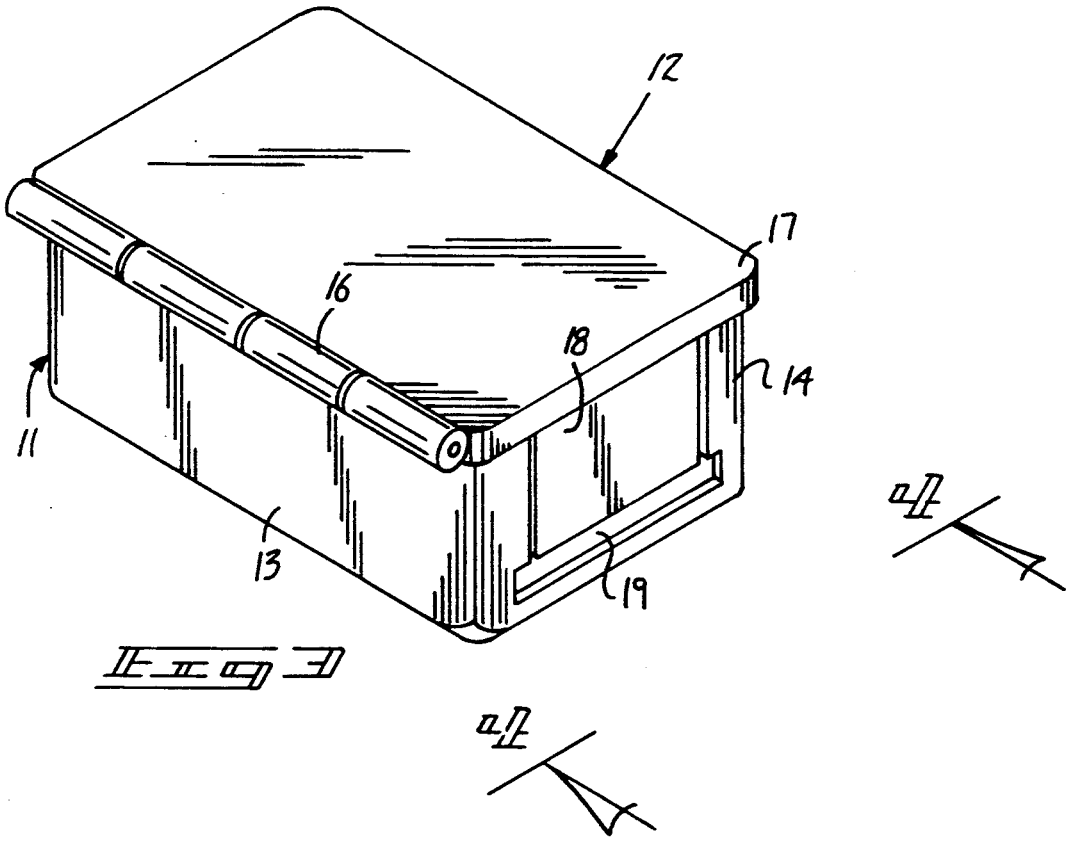
Fig 3
Fig 4
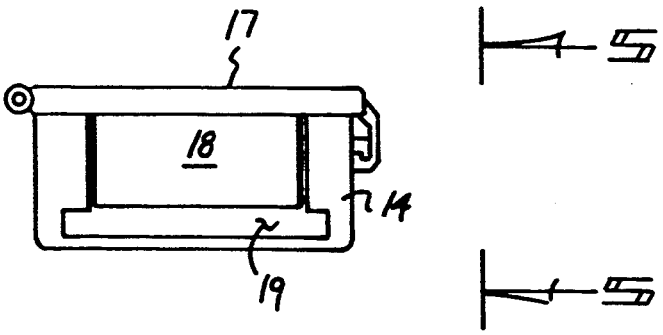

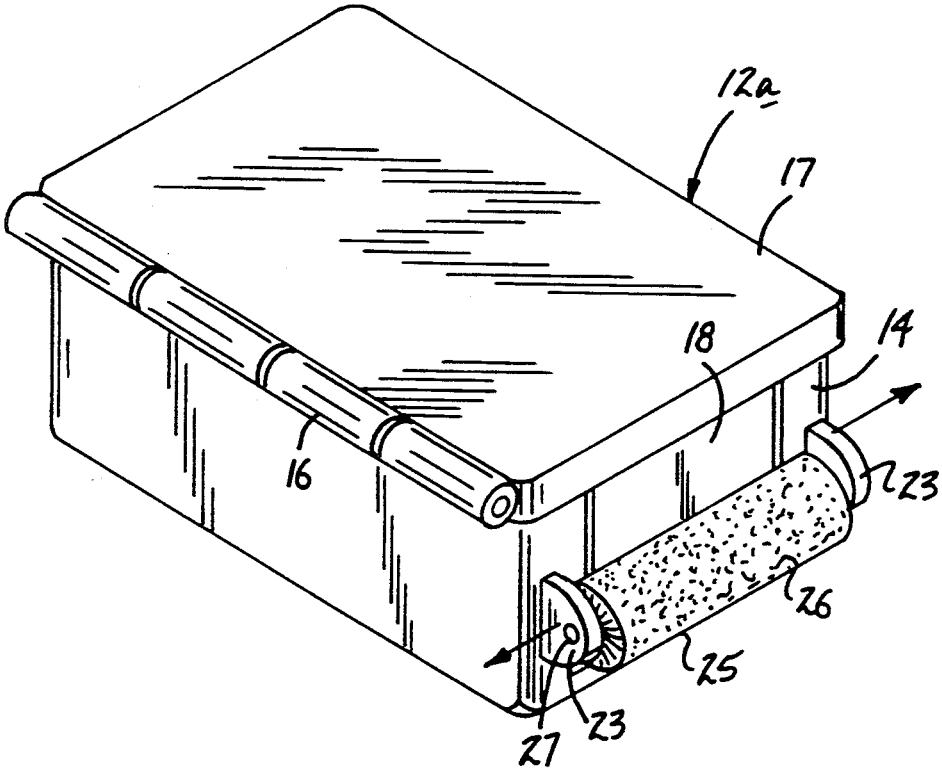
Fig 8
Fig 9
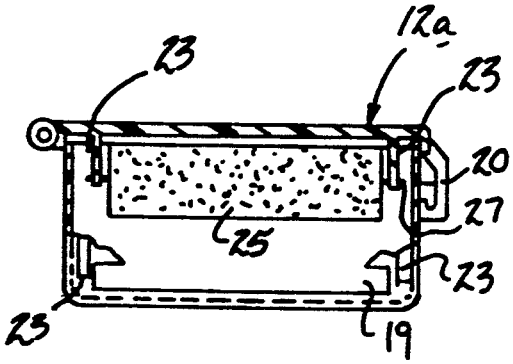

SEAT BELT GUARD

BACKGROUND OF THE INVENTION

1. Field of the Invention

The field of invention relates to seat buckle apparatus, and more particularly pertains to a new and improved seat belt guard arranged for securement about a seat belt latched assembly to prevent inadvertent tampering of the assembly by a child and the like.

2. Description of the Prior Art

Seat belts are utilized to deter children and adults of limited capacity from inadvertently opening the seat belt during use of the seat belt assembly, such as in a vehicle and the like. To prevent jeopardizing a passenger's safety, the instant invention sets forth the construction to secure the seat belt structure in use.

Prior art apparatus is exemplified in U.S. Pat. No. 4,731,912 to Boriskie, et al. wherein a seat belt guard includes a housing cover to overlie a clasped seat belt arrangement.

U.S. Pat. No. 4,502,194 to Morris, et al. sets forth a child proof seat belt utilizing a slide-on cover to receive the seat buckle and associated latch plate therewithin.

U.S. Pat. No. 4,136,328 to Camberon sets forth a seat belt system utilizing an electrical interlock.

U.S. Pat. No. 4,791,711 to Adams sets forth a child resistant buckle for use in seat belts, and U.S. Pat. No. 4,878,277 to Portuese sets forth a child-proof belt restraint arranged for mounting a seat buckle and latch arrangement therewithin.

As such, it may be appreciated that there continues to be a need for a new and improved seat belt guard as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of seat belt apparatus now present in the prior art, the present invention provides a seat belt guard wherein the same is arranged for containing an assembled seat belt buckle arrangement in a tamper-proof association. As such, the general purpose of the present invention, which will be described subsequently in greater detail, is to provide a new and improved seat belt guard which has all the advantages of the prior art seat belt apparatus and none of the disadvantages.

To attain this, the present invention provides a seat belt including first and second webs, including a latch housing cooperative with a buckle tongue for securement together. A container housing is positionable about the assembled latch housing and buckle tongue in a latched configuration, with the container housing including a lid hingedly mounted to the underlying container housing, with the lid including spaced flanges received within side wall openings to define side wall belt slots to contain the assembled buckle tongue and latch housing together.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved seat belt guard which has all the advantages of the prior art seat belt apparatus and none of the disadvantages.

It is another object of the present invention to provide a new and improved seat belt guard which may be easily and efficiently manufactured and marketed.

It is further object of the present invention to provide a new and improved seat belt guard which is of a durable and reliable construction.

An even further object of the present invention is to provide a new and improved seat belt guard which is susceptible of a low cost of manufacture with regard to both materials and labor, and which accordingly is then susceptible of low prices of sale to the consuming public, thereby making such seat belt guards economically available to the buying public.

Still yet another object of the present invention is to provide a new and improved seat belt guard which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric illustration of a guard housing utilized by the invention.

FIG. 4 is an orthographic view, taken along the lines 4—4 of FIG. 3 in the direction indicated by the arrows.

FIG. 8 is a modified guard housing utilizing a cleaning roll.

FIG. 9 is an orthographic side view, partially in section, of the cleaning roll contained within the housing during periods of storage thereof.

DESCRIPTION OF THE PREFERRED EMBODIMENT

Figures 1, 2:
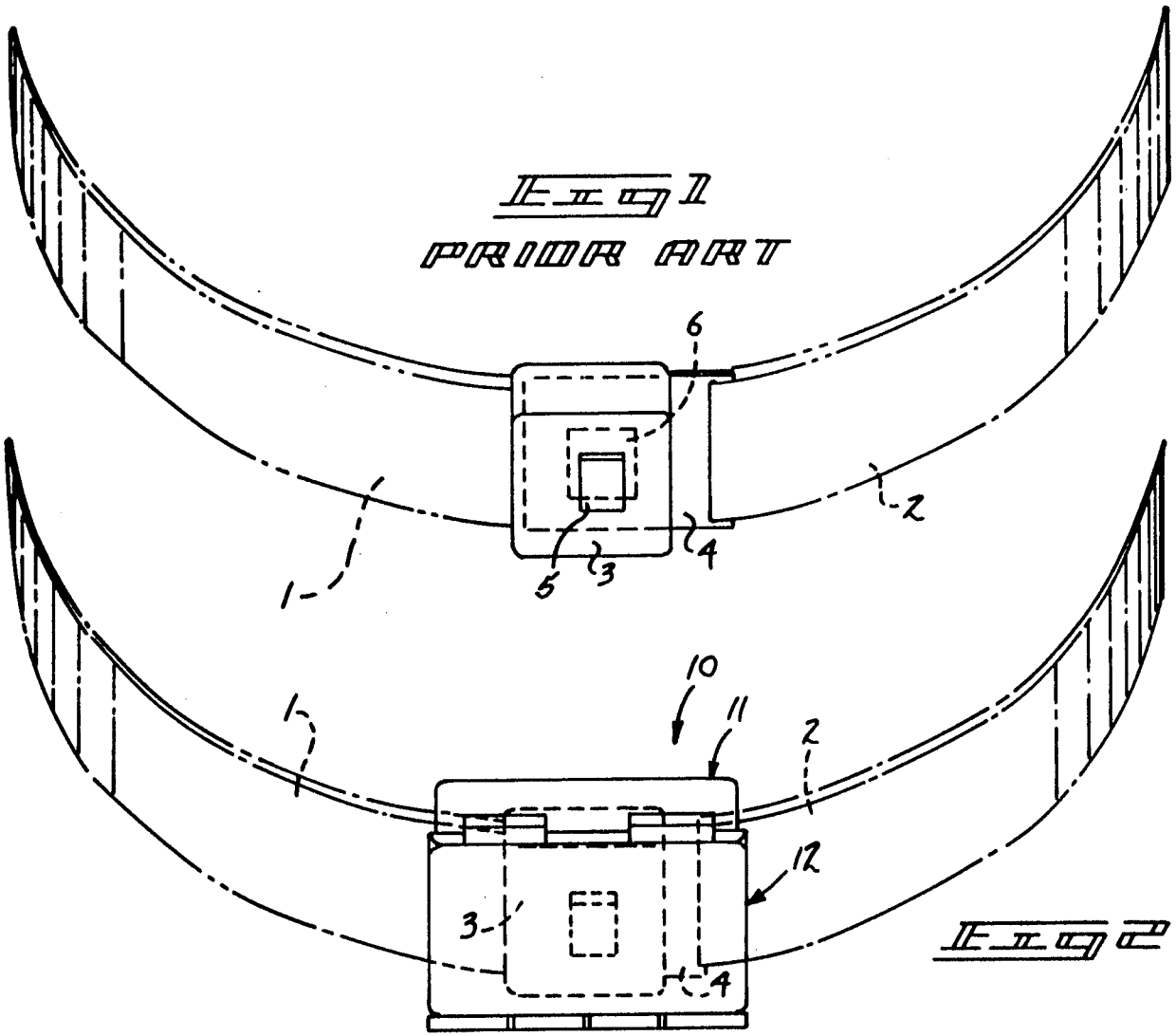
FIG 1 PRIOR ART
FIG. 1 is an isometric illustration of a seat belt arrangement.
FIG. 2 is an isometric illustration of the invention in association with a seat belt arrangement.
Figure 5:
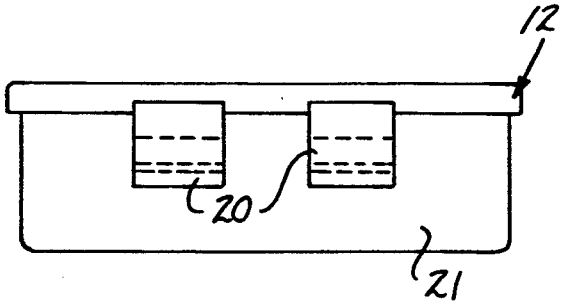
FIG. 5 is an orthographic view, taken along the lines 5—5 of FIG. 4 in the direction indicated by the arrows.
Figure 6:
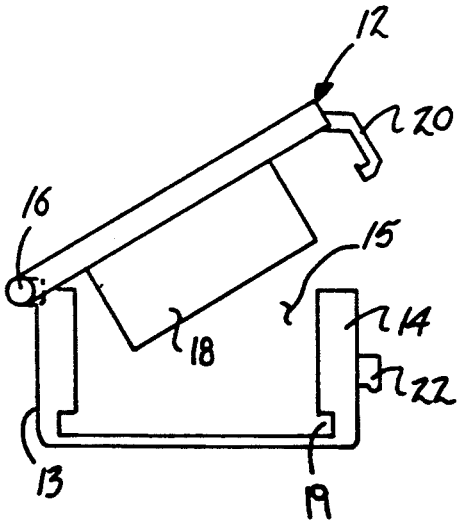
FIG. 6 is an orthographic side view of the housing structure in an opened configuration.
Figure 7:
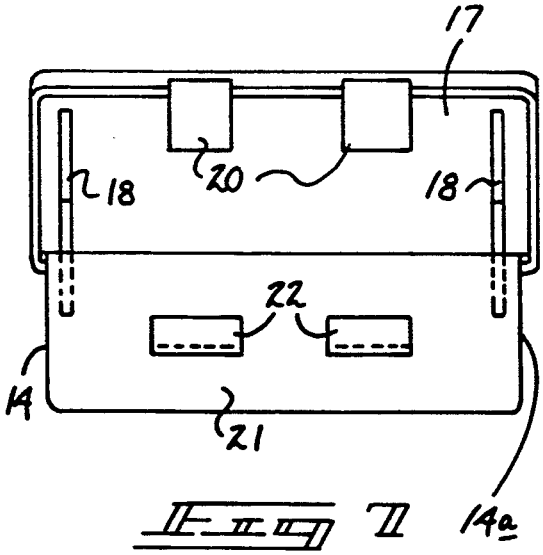
FIG. 7 is an orthographic frontal view of the guard housing, as illustrated in FIG. 6.

With reference now to the drawings, and in particular to FIGS. 1 to 9 thereof, a new and improved seat belt guard embodying the principles and concepts of the present invention and generally designated by the reference numeral 10 will be described.

More specifically, the seat belt guard 10 of the instant invention essentially comprises a seat belt construction, including a first belt web 1 cooperative with a second belt web 2, wherein the first belt web 1 includes a latch housing 3 cooperative with a buckle tongue 4 mounted to the second belt web 2. The buckle tongue includes a tongue opening 6 cooperative with a release button 5 to effect selective securement of the organization in an assembled configuration, as illustrated in FIGS. 1 and 2. A container housing 11 is positioned to receive the assembled latch housing 3 and buckle tongue 4, as illustrated in FIG. 2 therewithin. A lid 12 includes a hinge 16 to hingedly mount the lid 12 to a housing rear wall 13 of the container housing 11. The container housing 11 includes housing right and left side walls 14 and 14*a* respectively, each including a defining a "T" shaped side wall opening 15 defined by a predetermined height. Lid flanges 18 fixedly and orthogonally mounted to an interior surface of the lid top wall 17 are spaced apart a predetermined spacing equal to a predetermined spacing defined between the housing right and left side walls 14 and 14*a* . The lid flanges 18 are defined by a flange height less than the predetermined height to define side wall lower belt slots 19 when the lid 12 is secured to the housing 11 to receive the first and second belt webs 1 and 2 therethrough. A plurality of latch plates 20 are fixedly mounted to the lid 12 projecting downwardly therefrom and cooperative with housing front wall latch bosses 22 mounted to the housing front wall 21. In this manner, the assembled latch housing 3 and associated buckle tongue 4 are secured within the assembled container housing and lid preventing tampering of the release button 5 by a child and the like to prevent inadvertent separation of the first and second belt webs relative to one another from the assembled configuration.

A modified lid and right side wall structure are illustrated in FIGS. 8 and 9. The right side wall 14 includes a plurality of right side wall support flanges 23 mounted to the right side wall in an orthogonal relationship positioned on each side of the "T" shaped side wall opening 15. The support flanges 23 mount a roll axle 27 therebetween in a rotatable relationship to support a cleaning roll 25, wherein the cleaning roll 25 is oriented in FIG. 8 in tangential alignment with a side wall belt slot 19 through the right side wall 14. The cleaning roll 25 includes a bristle matrix 26 coextensive with an exterior surface of the cleaning roll 25 to effect a cleaning of the seat belt organization to remove excess debris from the structure of the second belt web 2 an associated buckle tongue 4 to ensure proper securement of the latch housing and buckle tongue together. During periods of storage, the cleaning roll 25 is mounted within lid support flanges 24 positioned orthogonally to the bottom surface of the lid top wall 17. The flanges 24 and 23 are of a flexible construction formed of a memory retentent material, wherein they are arranged to permit deflection relative to one another to provide assemblage of the cleaning roll 25 relative to the flanges 23 and 24 as desired.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A seat belt guard for securement to a seat buckle, wherein the seat buckle includes a latch housing releasably securing a buckle tongue therewithin, wherein the guard comprises, a container housing, the container housing including a housing rear wall and a lid hingedly mounted to the housing rear wall, the housing including a forward wall, a right side wall, and a left side wall, the lid including at least one latch plate fixedly and orthogonally extending downwardly from the lid, wherein at least one latch plate is cooperative with a latch boss, the latch boss fixedly and securedly mounted to the housing front wall, and the left and right side wall each including a "T" shaped side wall opening, and the right and left side walls spaced apart a predetermined spacing, and the lid including a right and left lid flange fixedly and orthogonally mounted to a bottom surface of the lid, wherein the right and left lid flanges are spaced apart the predetermined spacing and received within the respective right and left "T" shaped side wall opening, and each "T" shaped side wall opening defined by a predetermined height, and each lid flange defined by a flange height less than the predetermined height, wherein a respective right and left side wall lower belt slot is defined within each "T" shaped side wall opening when each respective lid flange is positioned within each side wall opening, and the at least one latch plate is secured to the at least one latch boss.

2. A seat belt guard as set forth in claim 1 including a cleaning means mounted to the right side wall for effecting cleaning of the buckle tongue and second belt web.

3. A seat belt guard as set forth in claim 2 wherein the cleaning means includes a cleaning roll, the cleaning roll including a bristle matrix mounted to the cleaning roll extending outwardly thereof, wherein the bristle matrix is coextensive with an exterior surface of the cleaning roll, and the cleaning roll is tangentially aligned with the right side wall belt slot.

4. A seat belt guard as set forth in claim 3 wherein the cleaning roll includes a roll axle coaxially directed through the cleaning roll, and the right side wall includes a plurality of right side wall support flanges formed of a flexible memory retentent material permitting spreading of the right side wall support flanges apart for reception of the roll axle therewithin, and the right side wall support flanges are mounted on opposed sides of the right side wall "T" shaped side wall opening.

5. A seat belt guard as set forth in claim 4 including a plurality of lid support flanges fixedly and orthogonally mounted to the bottom surface of the lid top wall, wherein the lid support flanges are formed of the flexible memory retentent material to permit selective reception of the roll axle and cleaning roll for storage of the cleaning roll.

* * * * *